US005165459A

United States Patent [19]

Gaber et al.

[11] Patent Number: 5,165,459

[45] Date of Patent: Nov. 24, 1992

[54] WINDOW COVERING

[75] Inventors: Ira Gaber, W. Norwalk, Conn.; Cooper C. Woodring, Plandome, N.Y.

[73] Assignee: Better Mousetraps, Inc., Plandome, N.Y.

[21] Appl. No.: 609,470

[22] Filed: Nov. 5, 1990

[51] Int. Cl.[5] ..... E06B 9/30

[52] U.S. Cl. ..... 160/168.1; 160/176.1; 160/236

[58] Field of Search ..... 160/236, 168.1, 176.1, 160/115, 177

[56] References Cited

U.S. PATENT DOCUMENTS 1,112,071 12/1914 Knopf .
2,459,517 1/1949 Gearhart ..... 160/115
2,543,097 2/1951 Drefke .
2,570,608 10/1951 Spiegel .
2,670,037 2/1954 Hunter .
3,032,099 5/1962 Croxen .
3,122,954 3/1964 Nadosy .
4,593,738 6/1986 Yu .
4,795,515 1/1989 Kao et al. ..... 160/84.1 X

OTHER PUBLICATIONS

Louverdrape Catalog (no date).

*Primary Examiner*—Blair M. Johnson
*Attorney, Agent, or Firm*—George P. Hoare, Jr.

[57] ABSTRACT

Disclosed in a window covering having a headrail and a plurality of slats suspended therefrom, the slats are adapted to pivot and thereby contact contiguous slats to form dead air cells for improved appearance and insulating properties.

17 Claims, 12 Drawing Sheets

WINDOW COVERING

FIELD OF THE INVENTION

The present invention is generally directed to window coverings for residential and commercial use and particularly to venetian blind type window coverings which form thermal insulating and noise dampening cells.

BACKGROUND OF THE INVENTION

Consumers desire attractive and easy to install and operate window coverings. Additionally, energy conservation has spurred interest in improving the insulating efficiency of window coverings.

Venetian-type blinds are the most popular window coverings. This is due in large measure to their ability to control light penetration, viewing area and privacy without raising or lowering the blinds or slats. This is accomplished by a ladder-like supporting device suspended between a headrail and footrail which includes a pair of vertical string-like members connected together by spaced apart rungs, typically made out of fabric. The string-like members are spaced apart at a distance approximately equal to the width of the individual slats and thereby abut against the outside edges of the slats. As one of the pair of strings is raised and the other is lowered the rungs that support the slats tilt causing the support slates to tilt in unison.

Venetian-type blinds are also provided with a cord for raising or lowering the footrail which serves to raise or lower the slats. This cord is affixed to the footrail and passes through aligned elongated holes in each of the slats. As the cord is pulled, the footrail rises causing the slats to sequentially stack on the footrail.

Venetian-type blinds of such construction are disadvantageous for several reasons. Because the string-like members abut against the outside edges of the slats, adjacent slats are prevented from coming together as the string-like members are raised and lowered. A pathway therefore exists at all times between adjacent slats and through the holes in the slats used for the string-like members and the raising and lowering cord. This pathway permits the unwanted transmission of light, heat and sound thereby compromising the insulating properties of the window covering. In addition, venetian blinds accumulate dust and grime which is particularly difficult to remove in the area where the string-like members gather or bunch on the outside edges of the slats.

Thus, venetian-type blinds do not provide the combination of viewing, privacy and insulating properties necessary to satisfy the demand for energy conserving window coverings.

SUMMARY OF THE INVENTION

The present invention is directed to a window covering having the combination of viewing, privacy and insulating properties which significantly exceeds that of conventional venetian-type blinds. The present window coverings can be adjusted to permit varying degrees of viewing including complete privacy with no unwanted light. In another aspect of the invention, the window covering can be adjusted to obtain maximum privacy and still permit the transmission of air.

In its fully closed position, contiguous slats of the window covering of the present invention come together in sealing engagement to form a stack of dead air cells for maximum insulation against heat and sound transmission. In a preferred embodiment, the cells formed between contiguous slats also hide from view the cords, the raising and lowering strings and the respective openings in the slats thereby improving the appearance of the window covering over conventional venetian blinds. In another preferred embodiment the cells formed between contiguous slats also hide from view the raising and lowering cords and their respective openings in the slats while the tilting cords remain visible.

In particular, the present invention is directed to a window covering comprising a headrail, and a plurality of slats operatively suspended from the head rail. Means are provided for pivoting the slats until contiguous slats come into contact with each other in sealing relationship to form dead air cells.

The slats are suspended by a supporting device preferably comprising a pair of vertically extending members attached to a tilting device in the headrail and members on or connected to at least one of the vertical members for supporting the slats. The vertical members extend through openings in the slats and are adapted to tilt the slats into and out of sealing engagement. Because the vertical members do not come into contact with the outside edges of the slats, the slats are free to pivot about a pivot point and come into contact with contiguous slats in sealing relationship. When contiguous slats are so positioned, they form dead air cells which serve as a thermal barrier with excellent noise dampening qualities. Additionally, the slats can have their edges locally relieved to accomodate the string-like members such that the slats can engage in the sealing relationship.

The slats preferably have a cross-section in which the opposed edges of the slats lie in respective planes above and below a parallel plane passing through the pivot point of the slats. As a result, when the slats are pivoted about the pivot point, the edge of one slat is able to contact and form a seal with the surface of a contiguous slat.

Further, and as will be described hereinafter in greater detail, the present invention includes a device for gathering and spacing the slats independently of the supporting device for pivoting the slats.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

Figure 1A:
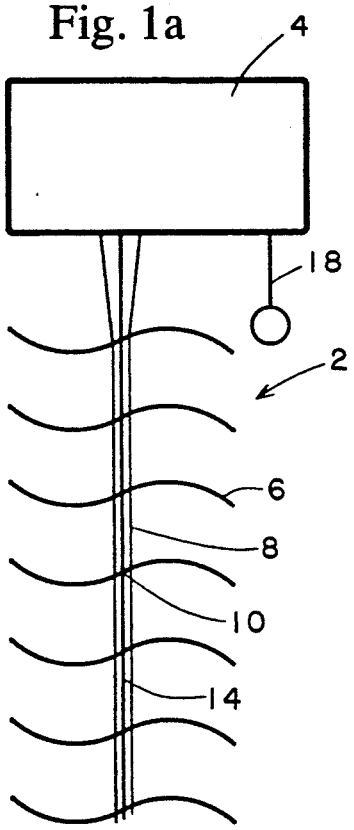
FIGS. 1A–1C are elevational views of one embodiment of the window covering of the invention showing the slats in the open position, the closed position and the window covering in the raised position with the slats stacked one upon the other.
Figure 1B:
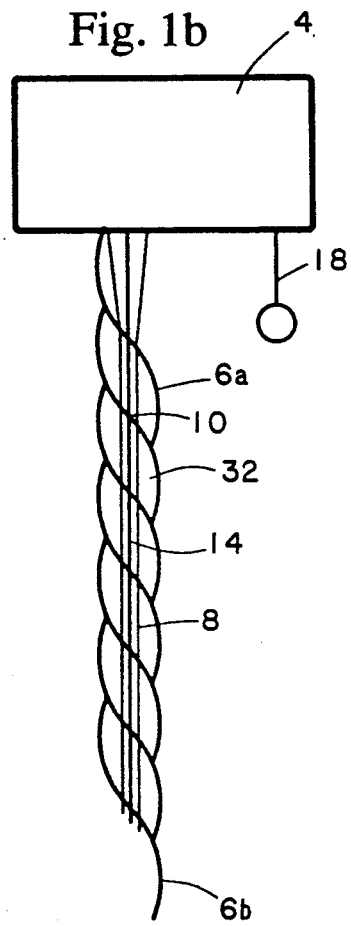
Figure 1C:
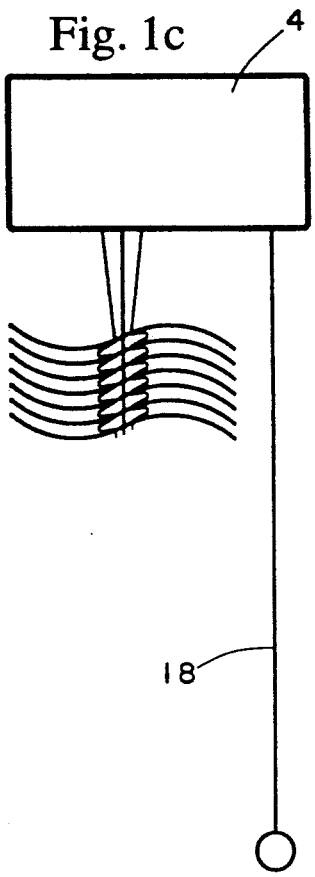
Figure 2A:
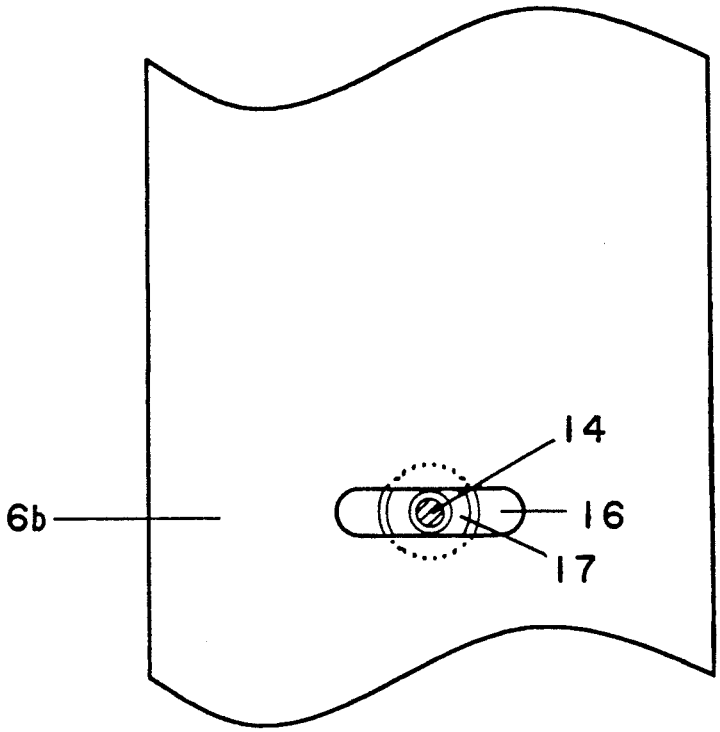
FIG. 2A is partial plan view of the raising and lowering cord attachment to the bottom most slat.
Figure 2B:
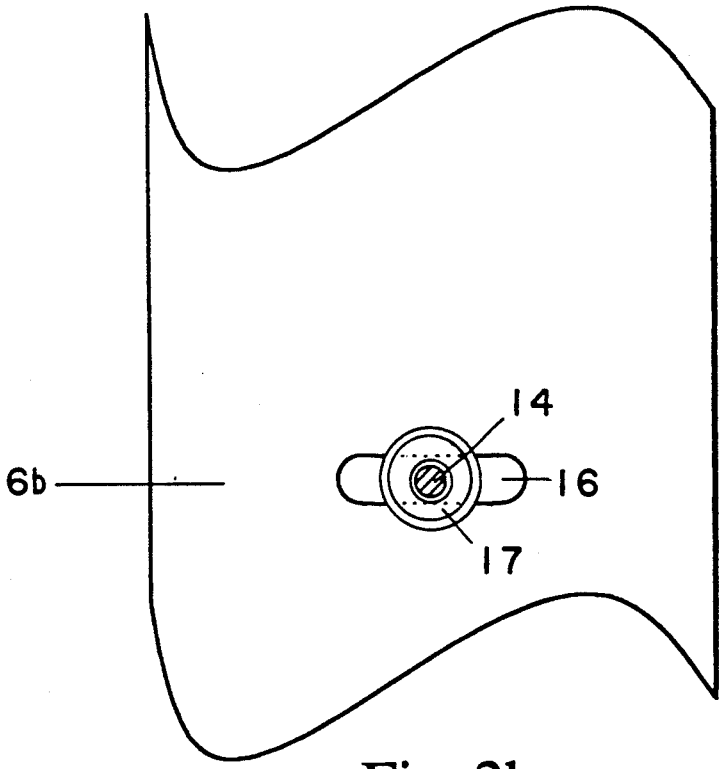
FIG. 2B is a partial bottom view of the slat shown in FIG. 2A.

Referring to the drawings and particularly to FIGS. 1A–1C there is shown a preferred embodiment of a window covering 2 of the invention including a headrail 4, a plurality of slats 6 suspended from the headrail 4, and a support device 8 for supporting the slats 6 including a top slat 6*a* and a bottom slat 6*b* and for pivoting the slats 6 to rotate from a fully opened position shown in FIG. 1A to a fully closed position shown in FIG. 1B. The window covering 2 also includes at least one cord 14 which passes through corresponding aligned holes 16 (shown best in FIGS. 2A and 2B) in the slats 6. The cords 14 are combined in the headrail 4 into a single pull cord 18 enabling the user to easily raise or gather and lower or space the slats of the window covering 2.

The cords 14 are attached to the bottom of the window covering 2 so that when the cords 14 are raised the slats 6 stack one on top of the other as shown in FIG. 1C. As shown best in FIGS. 2A and 2B, the cords 14 are attached to the bottom slat 6*b* by a knot 17 which is of greater size than the corresponding hole 16 in the slat 6*b*. The knot 17 is of sufficient size so that it cannot be pulled through the hole 16 during the raising and lowering of the window covering 2.

Figure 3A:
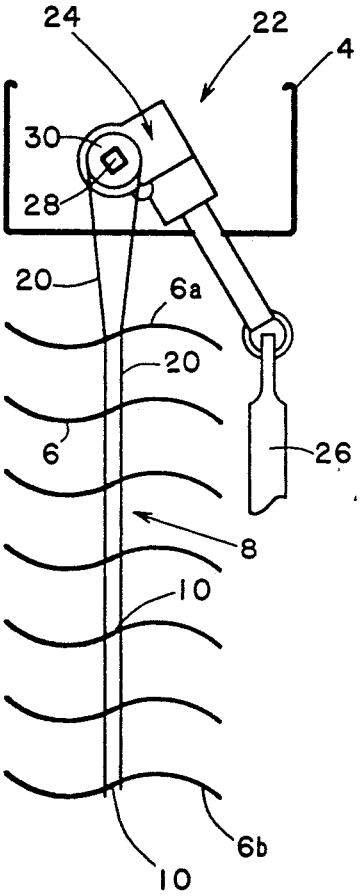
FIGS. 3A–3C are respective partial cross-sectional views of the upper portion of the window covering shown in FIGS. 1A–1C.
Figure 3B:
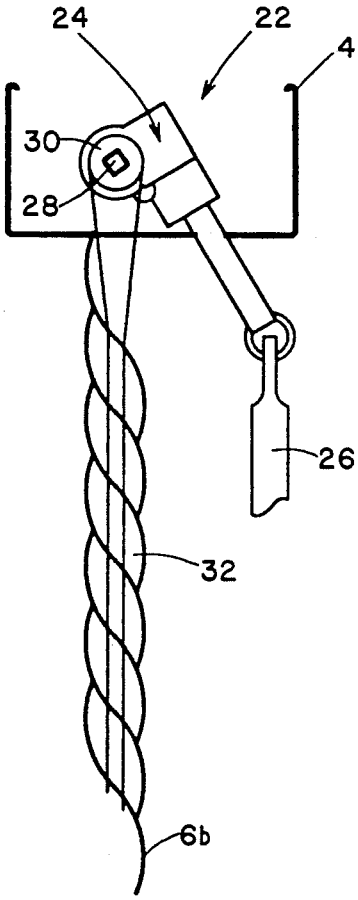
Figure 3C:
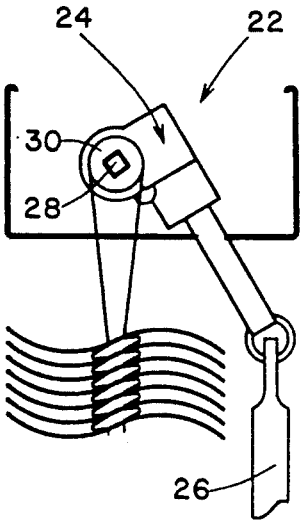

The slats 6 are caused to pivot about the pivot point 10 until the contiguous slats contact each other to form dead air cells 32 as shown in FIG. 1B. The preferred mechanism for pivoting the slats 6 is best shown in FIGS. 3A–3C.

More specifically, each of the slats 6 is supported by the supporting device 8 which preferably includes a pair of spaced apart members 20. The supporting device 8 is attached at one end to the bottom slats 6*b* as previously described or to any other portion of the window covering which can rise in unison with the slats, such as traditional footrail. The opposed end of the supporting device 8 is attached to a rotation assembly 22 preferably positioned within the headrail 4.

The rotation assembly 22 includes a gear box 24 operatively connected to a rod 26 which can be rotated by the user. A shaft 28 extends from the gear box 24 along the length of the window covering 2. The shaft 28 has a rotating tilt drum 30 for receiving the upper ends of the spaced apart members 20.

The gear box 24 contains an arrangement of gears sufficient to translate the rotational movement of the rod 26 applied by the user to a rotational movement enabling the shaft 28 to rotate about its axis. The tilt drum 30 rotates in unison with the shaft 28 causing one spaced apart member 20 to rise and the other spaced apart member 20 to fall. The slats 6 move in concert with the members 20 and are thereby caused to pivot about the pivot point 10 until contiguous slats come into contact with each other in sealing relationship and form dead air cells 32 as shown best in FIG. 3B.

As illustrated, the cord 14 gathers and spaces the slats 6 independently of the pivoting supporting device 8. Conversely, and as illustrated, the support device 8 operates independently of the slat gathering and spacing cord 1.

Figure 4A:
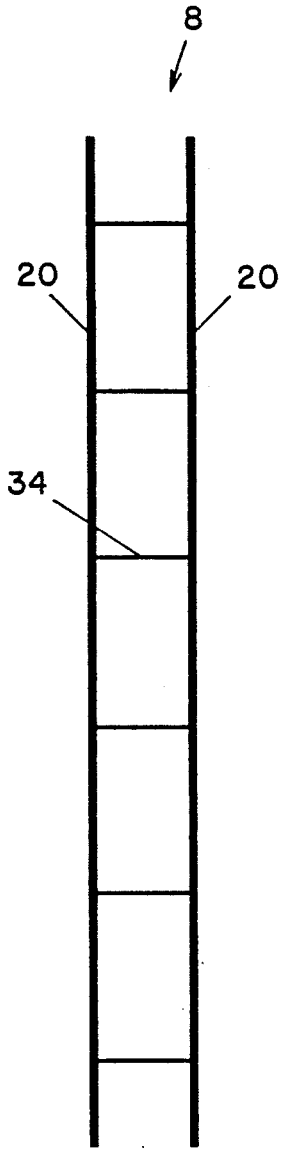
FIG. 4A is a partial elevational view of one embodiment of the slat supporting device employed in the present invention.

In one embodiment, the support device 8 includes spaced apart members 20 connected together by a plurality of transverse members such as rungs 34 as shown in FIG. 4A. The support device 8 is placed in supporting engagement with the slats 6 through an opening centrally positioned between the edges of the slat. Illustratively, the slats 6 are placed on the rungs 34 and entrapped between the spaced apart members 20.

Figure 5A:
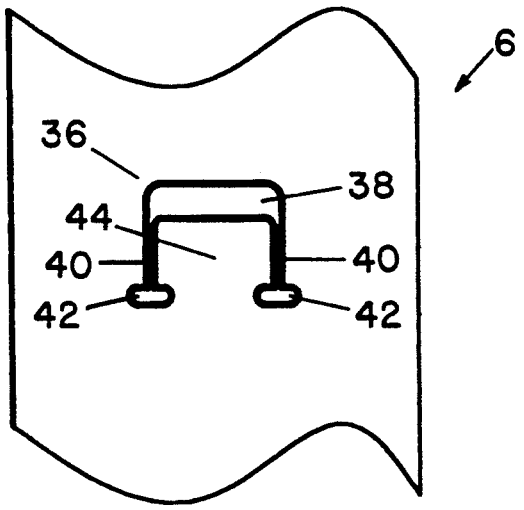
FIG. 5A is a partial plan view of a slat showing the opening for receiving the supporting device shown in FIG. 4A and an opening for receiving the raising and lowering cord.

More specifically, as shown in FIG. 5A, each slat 6 is provided with a horse shoe shaped slot 36 including a central opening 38 and spaced apart slits 40 having end portions 42 separated by a slat portion 44. The support device 8 shown in FIG. 4A is inserted through the central opening 38 so that the rung 34 lies beneath the slat portion 44 to provide support for the slat 6.

Figure 5B:
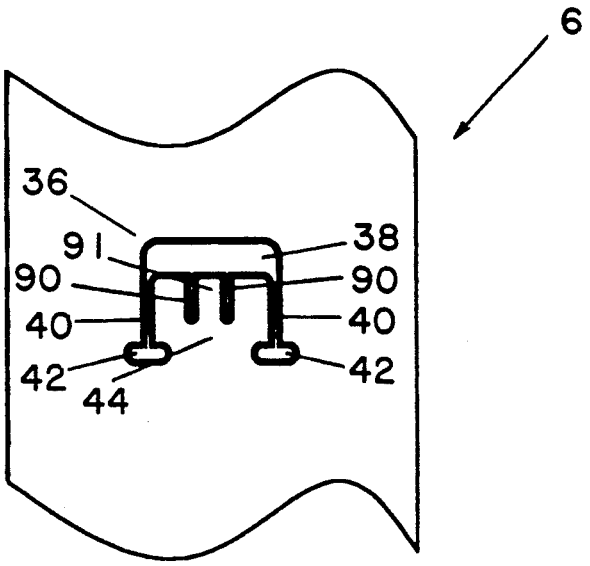
FIG. 5B is a partial plan view of a slat showing an alternative embodiment of FIG. 5A having an anchor means to minimize unwanted rotation of a slat that may be caused by wind currents.

In another embodiment of the invention shown in FIG. 5B, means are provided to anchor the rung 34 of support means 8 to slat 6 to minimize unwanted rotation of a slat that may be caused by wind currents. Slat portion 44 has two slits 90 and an anchor tab 91, whereby portions of the rung 34 pass from below slat portion 44 through slits 90 above anchor tab 91 and are thereby captured between anchor tab 91 and end portions 42. The spaced apart members 20 are passed through the respective slits 40 to the end portions 42 leaving the central opening 38 free to house the raising and lowering cord 14.

The members 20 are spaced apart in a manner which enables them to frictionally engage the edges of the end portions 42 of the horse shoe-shaped slot 36 in the slats 6. When one of the members 20 is raised, it engages the edges of the end portions 42 and pivots one edge upwardly and the other edge downwardly to thereby move the slats to the fully closed position as shown in FIG. 3B. In this position, the slats 6 come into contact with each other to form the dead air cells 32 for maximum privacy with no unwanted transmission of light. If the other member 20 is raised, the slats 6 will pivot in the opposite direction causing the contiguous slats to disengage from the sealed relationship into the fully opened position shown in FIG. 3A allowing maximum viewing and light penetration. Of course, movement of the members 20 may be terminated to place the slats 6 in a variety of intermediate positions between the fully opened and fully closed positions.

As the slats are moved between the fully closed and fully opened positions, the user can adjust the amount of view and the degree of light penetration. In accordance with the invention, the slats may be partially closed to obtain maximum privacy and still permit the transmission of light and air through the window covering.

Figure 4B:
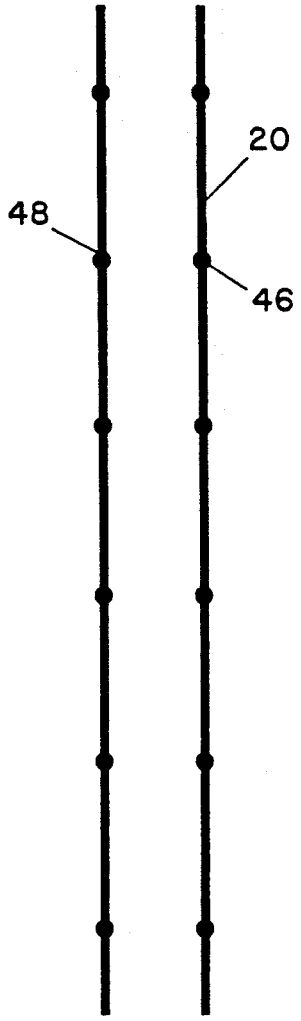
FIG. 4B is a partial elevational view of another embodiment of the slat supporting device employed in the present invention.
Figure 5C:
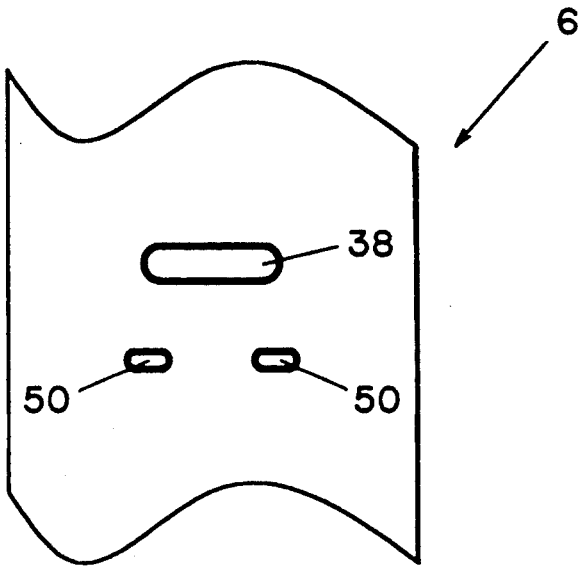
FIG. 5C is a partial plan view of a slat showing the opening for receiving the supporting device shown in FIG. 4B and an opening for receiving the raising and lowering cord.

In another embodiment of the invention, the spaced-apart members 20 have nodes 46 of sufficient size so as to provide a ledge 48 for supporting the slats 6 as shown in FIG. 4B. The spaced apart members 20 of FIG. 4B may be press-fitted through elongated holes 50 in the slats 6 as shown in FIG. 5C. The nodes 46 reside below the slat 6 when the slats are loaded on the support device 8 and provide support for the slats 6 because the nodes 46 are of greater size than the width of the holes 50. The slats 6 therefore rest on the ledge 48 which prevents the slats 6 from sliding down the members 20. The slat 6 shown in FIG. 5B also has a central opening 38 as previously described for receiving the cord 14 used to raise and lower the window covering.

The support device 8 can be made from any flexible material, but is preferably made from textiles, fabrics and the like.

The slats 6 of the present window covering are adapted to pivot about pivot point 10 until the edge of one slat sealingly engages the surface of a corresponding contiguous slat and thereby forms a dead air cell 32.

Figure 6:
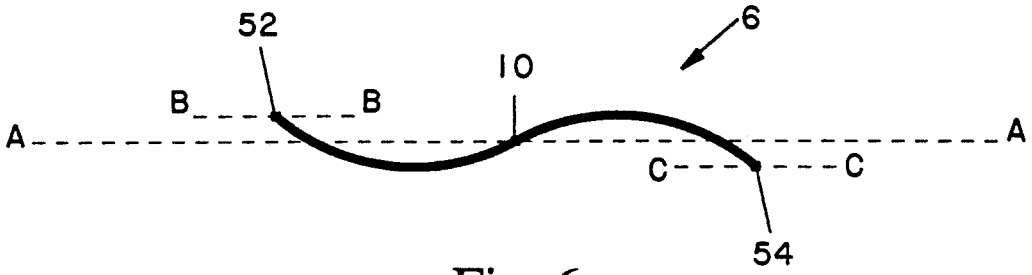
FIG. 6 is a side view of a slat of the present invention showing the positioning of the pivot point relative to the leading and trailing edges of the slat.

Referring to FIG. 6, the slats 6 have a leading edge 52, a trailing edge 54 and a pivot point 10. The pivot point 10 is between the edges 52 and 54. In accordance with the invention, the leading and trailing edges 52, 54 are above or below a plane passing through the pivot point 10. More specifically, a plane A—A passing through the pivot point 10 is between a parallel plane B—B passing through the leading edge 52 and a parallel plane C—C passing through the trailing edge 54. As a consequence, when the slat 6 is pivoted about the pivot point 10, the edges 52, 54 will extend far enough toward the corresponding contiguous slats 6 of the window covering 2 to insure sufficient contact to form the dead air cells 32. As a result, and as illustrated in the drawings (including FIGS. 7A–7L), the dead air cells 32 are formed by at least two layers of slats 6. In other words the pivot points 10 of the slats 6 are spaced apart at a distance less than one-half the width of the slats 6.

In a preferred form of the invention, the slats 6 are dynamically balanced. Accordingly, the weight of the slats 6 on either side of the pivot point 10 is preferably equal. It is therefore preferred to have the slat 6 pivot about its centerpoint so that the slat portions on either side of the pivot point 10 are equal in weight. This can be accomplished by positioning the end portions 42 of the opening 36 shown in FIG. 5A or the elongated holes 50 shown in FIG. 5B equally spaced from the pivot point 10 of the slat 6.

It should be understood however, that dynamic balance may be achieved without center point pivoting of the slats. If opposed end portions of the slats, have different weights, dynamic balance may be achieved by moving the pivot point closer to the heavier load. Dynamic balance is obtained according to the standard physical relationship of $L_1M_1=L_2M_2$ wherein $L_1$ and $L_2$ represent the length of the respective end portions of the slats and $M_1$ and $M_2$ are their respective masses.

It should also be understood that in some instances dynamic balance is not desired. For example, it may be desirable to add weight to one end portion of the slats to bias the slats toward the closed position shown in FIG. 3B. This can be accomplished by making the slot slightly heavier at one end portion.

Figures 7A, 7B, 7C:
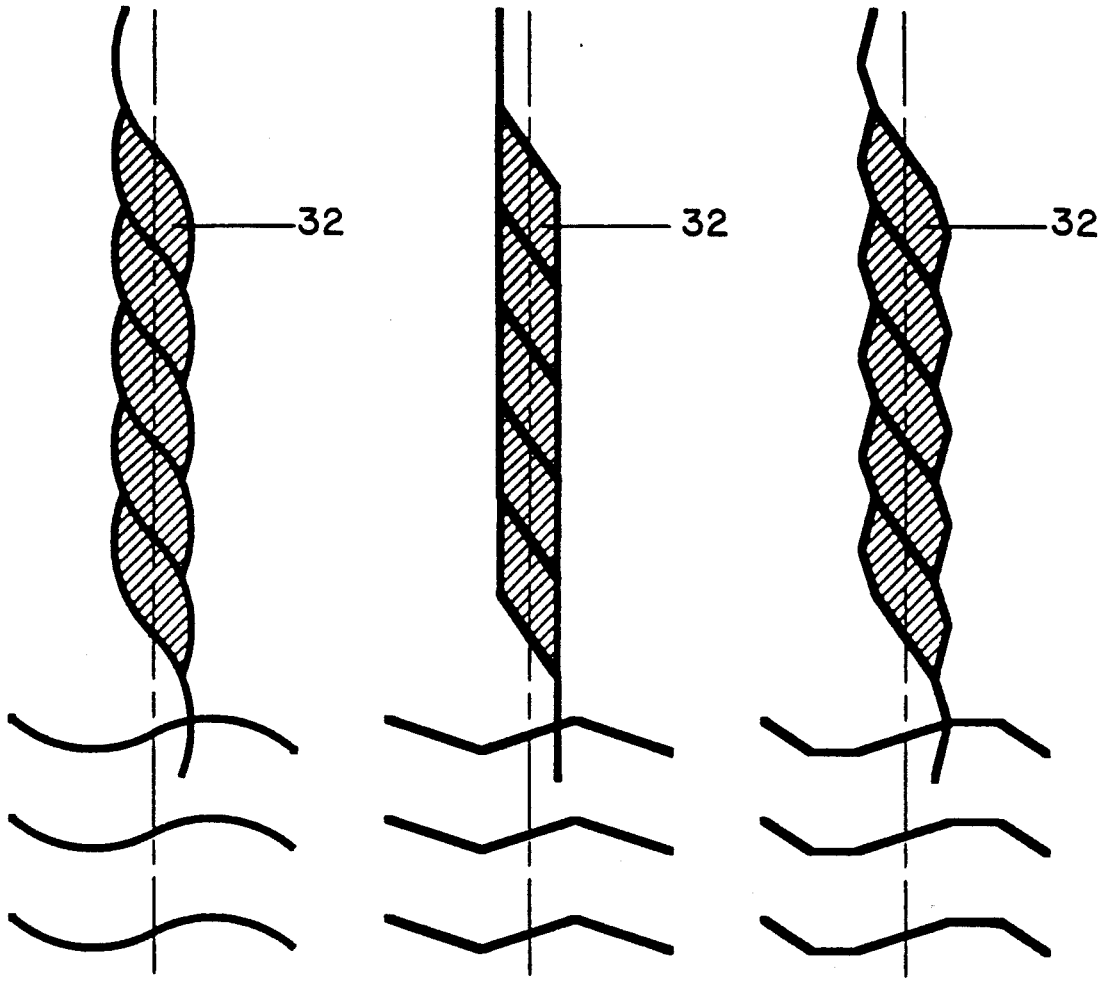
FIGS. 7A–7L partial elevational views of embodiments of the slats that may be used to form dead air cells in accordance with the present invention.
Figure 7D:
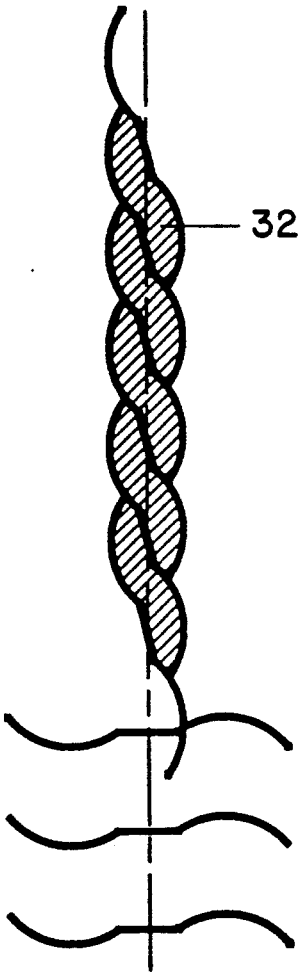
Figure 7E:
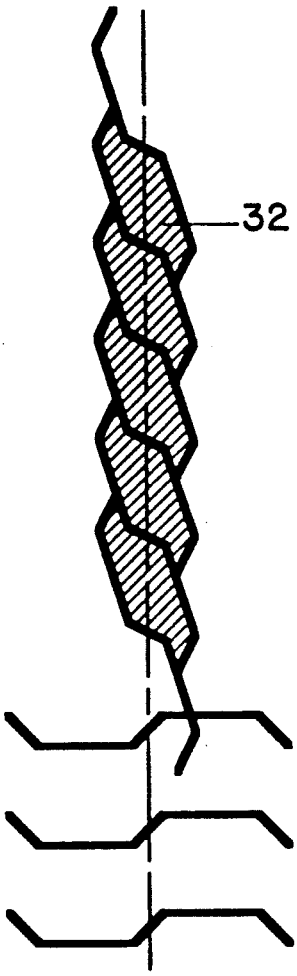
Figure 7F:
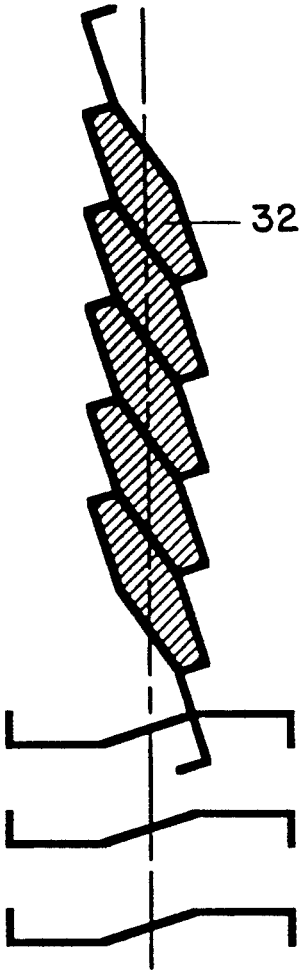
Figures 7G, 7H, 7I:
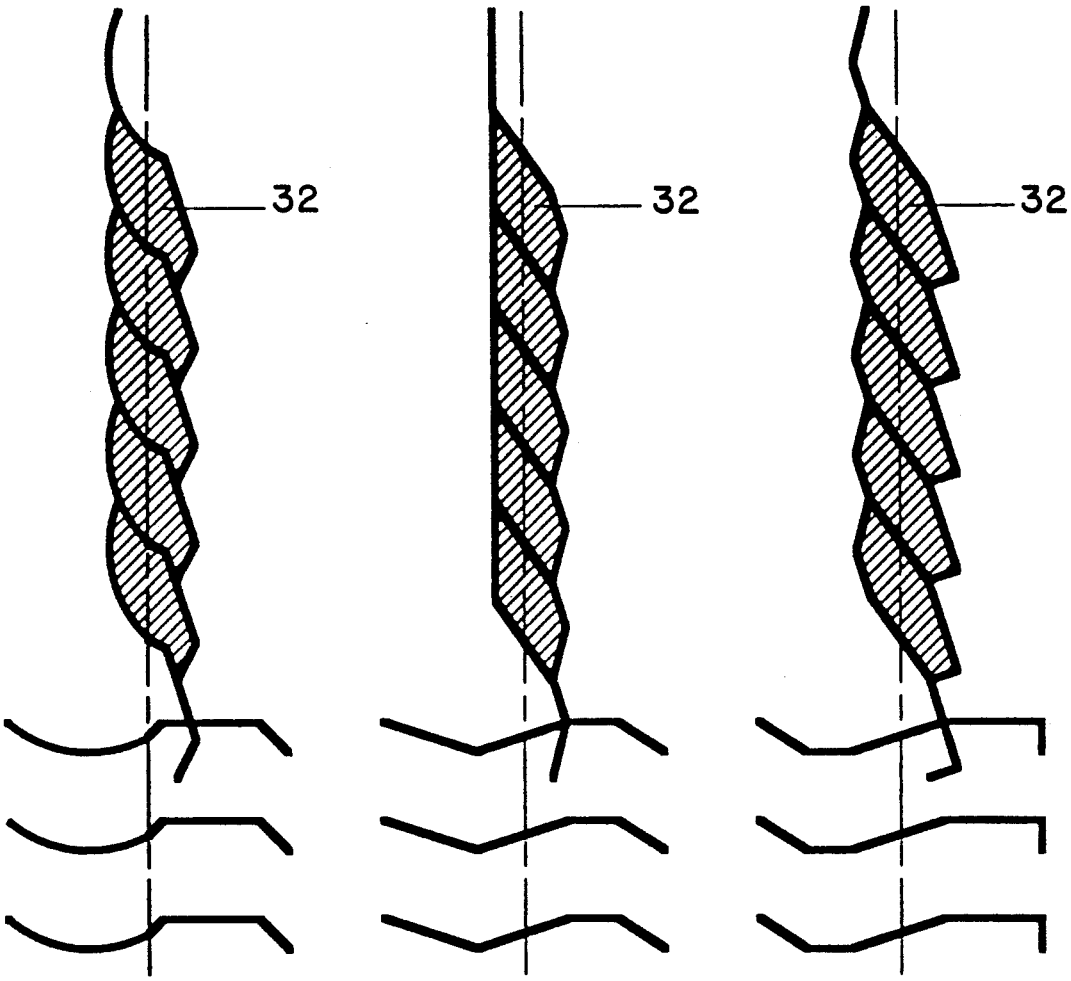
Figure 7J:
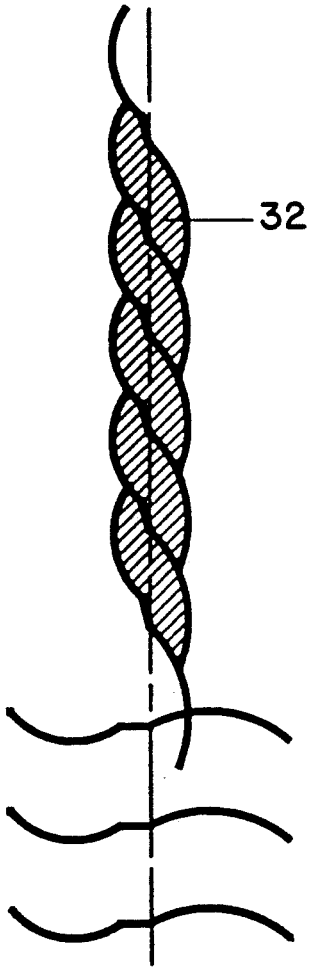
Figure 7K:
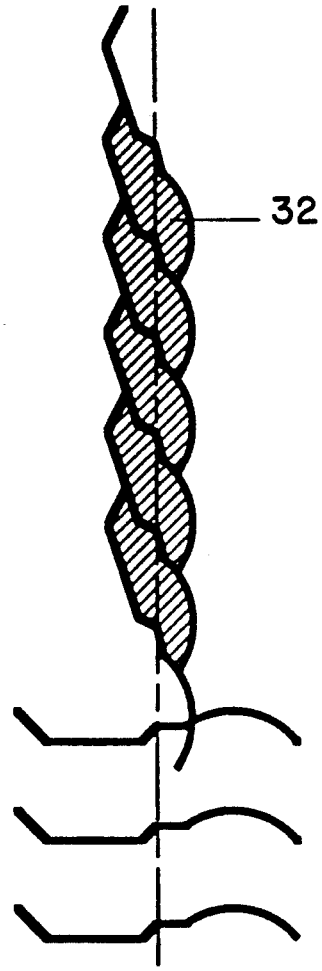
Figure 7L:
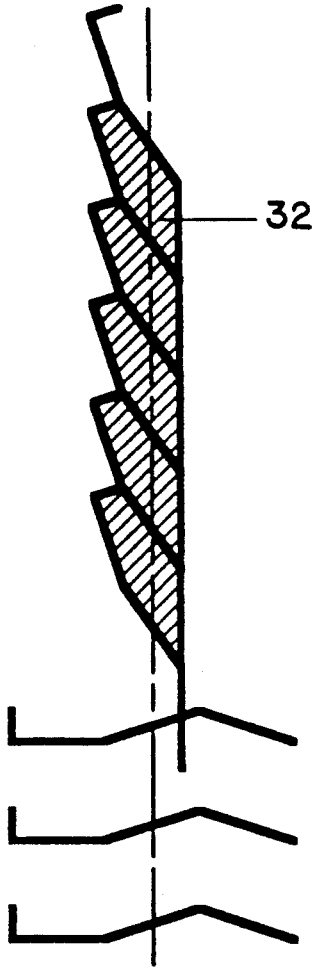

The slats preferably have an S-shaped cross-section with arcuate surfaces as shown in FIG. 7A. However, an almost limitless number of other slat configurations may be employed in accordance with the present invention. For example, slats having a modified S-shaped cross-section with at least one linear surface are shown in FIGS. 7B through 7F. Slats having asymmetrical cross-sections are shown in FIGS. 7G through 7L. These slat arrangements provide different facings on each side of the window covering. When each type of slat is pivoted, the respective window coverings present a unique and decorative facing. Thus, the present invention provides window coverings having a variety of aesthetically pleasing designs in addition to improved insulating properties through the formation of dead air cells.

As illustrated in FIGS. 7A–7L, the row of dead air cells 32 between adjacent slats 6 is continuous and contiguous, and the dead air cells 32 are in axial alignment and each cell 32 includes at least two layers of slats 6, all to provide the insulating and privacy features of the present invention.

The slats may be made of a variety of materials selected for their aesthetic appearance and insulating properties. Fabrics, lightweight metals including aluminum and laminates, plastics, and paper products and the like are effectively employed for the manufacture of the slats.

Figures 8A, 8B, 8C:
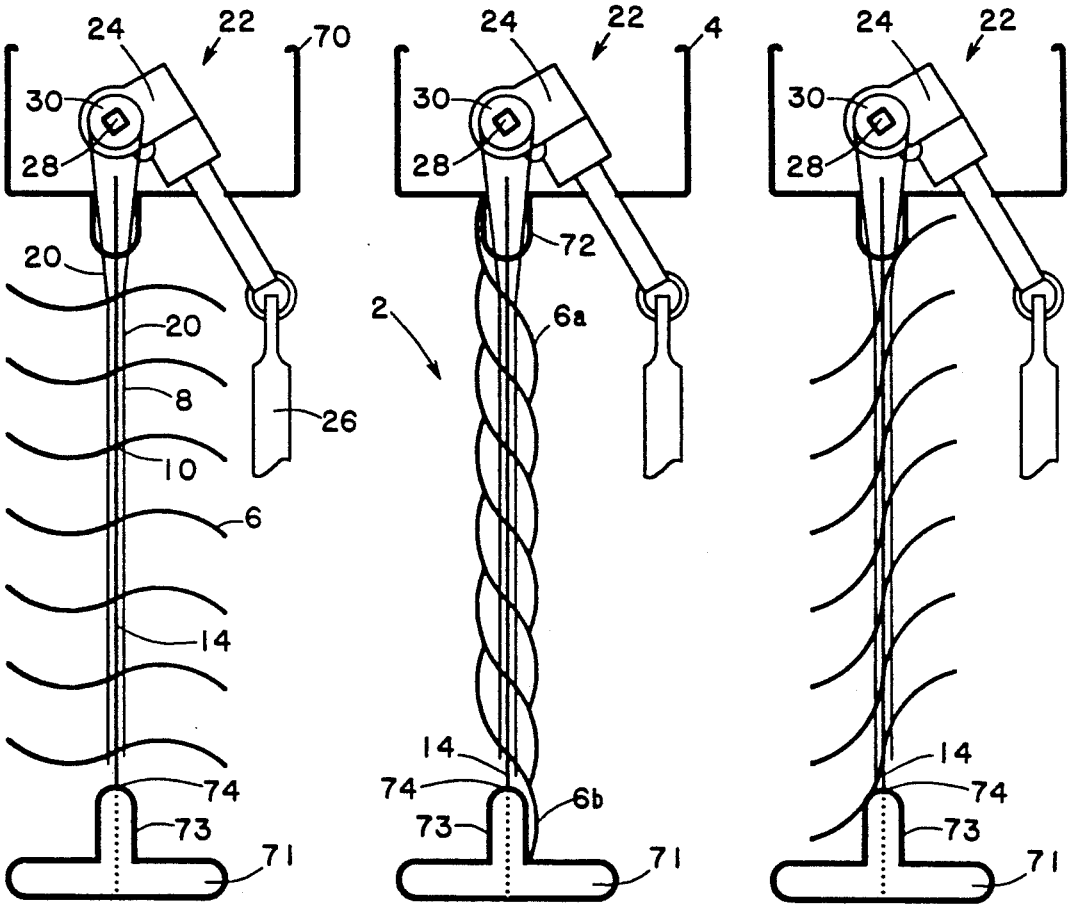
FIGS. 8A–8C are elevational views of embodiments of the window covering of the present invention employing a non-rotating bottom rail.

FIGS. 8A–8C show a preferred embodiment of a window covering 2 of the invention including a headrail 70, a bottomrail 71, a plurality of slats 6 suspended from the headrail 70, a support device 8 for supporting the slats 6 and for pivoting the slats about a pivot point 10 to cause the slats 6 to rotate from a fully opened position shown in FIG. 8A to a fully closed position shown in FIG. 8B, to a maximum privacy with transmission of air position shown in FIG. 8C.

As shown best in FIG. 8B, the headrail 70 has a downwardly oriented baffle 72 that seals with the top terminal slat **6*a* to obstruct light, sound and air current when the window covering 2 has been rotated to its fully closed position and to a maximum privacy with transmission of air position. The bottomrail 71 has an upwardly oriented baffle 73 that seals with the bottom terminal slat 6*b* to obstruct light, sound, and air current when the window covering 2** has been rotated to its fully closed position and to a maximum privacy with transmission of air position.

FIGS. 8A–C shows the cord 14 attached to the bottomrail 71 that will cause the bottomrail 71 to elevate and collect the slats 6 in a stack above it when the cord 14 is pulled. The cord 14 has its exit point 74 atop the bottomrail 71 which causes the bottomrail 71 to be held in a non-rotatable balanced position regardless of the rotation of the slats 6 or the elevation of the bottomrail 71.

Figure 9A:
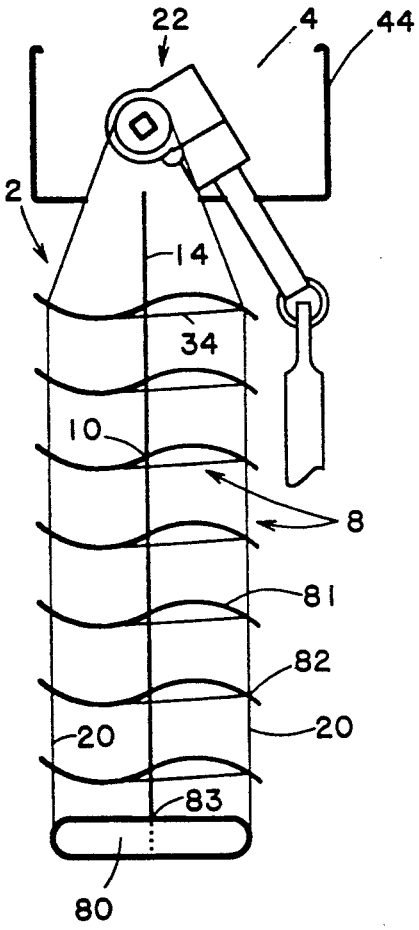
FIGS. 9A–9C are elevational views of embodiments of the window covering of the present invention employing a rotating bottom rail.
Figure 9B:
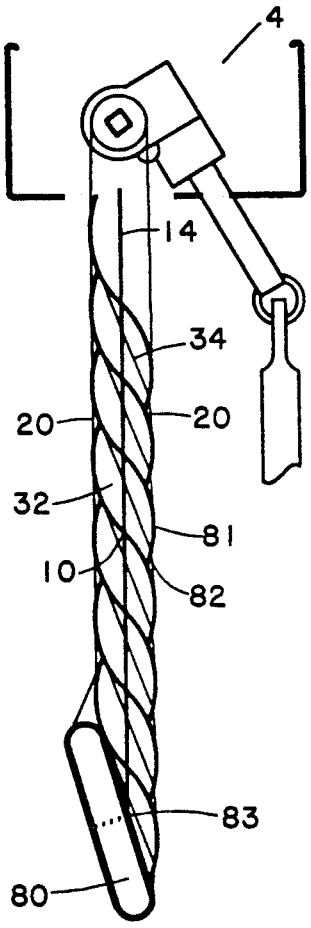
Figure 9C:
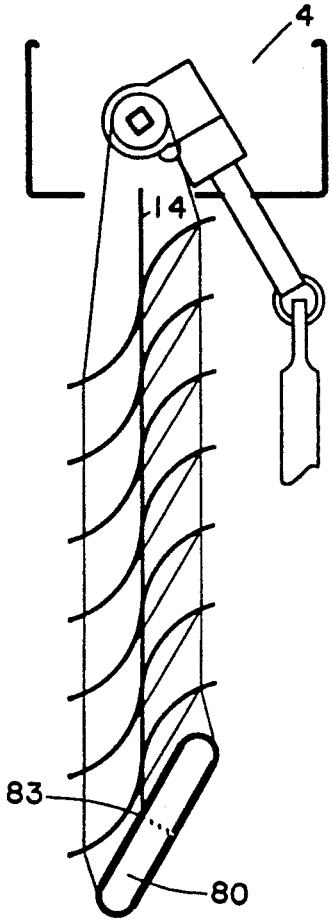

FIGS. 9A–C shows an embodiment of the window covering 2 including a headrail 4, a bottomrail 80, a plurality of slotted slats 81 suspended from the headrail 4, and a support device 8 for supporting the slats 81 and for pivoting the slats 81 about a pivot point 10 to cause the slats 81 to rotate from a fully opened position shown in FIG. 9A, to a fully closed position shown in FIG. 9B, to a maximum privacy with transmission of air position shown in FIG. 9C.

Each of the slats 81 is supported by the support device 8 which preferably includes a pair of spaced apart members 20 connected together by plurality of rungs 34 as shown in FIG. 4A. The support device 8 is attached at one end to the bottom of the bottomrail 80 and the opposing end is attached to the rotation assembly 22 preferably positioned within the headrail 4.

Figure 10:
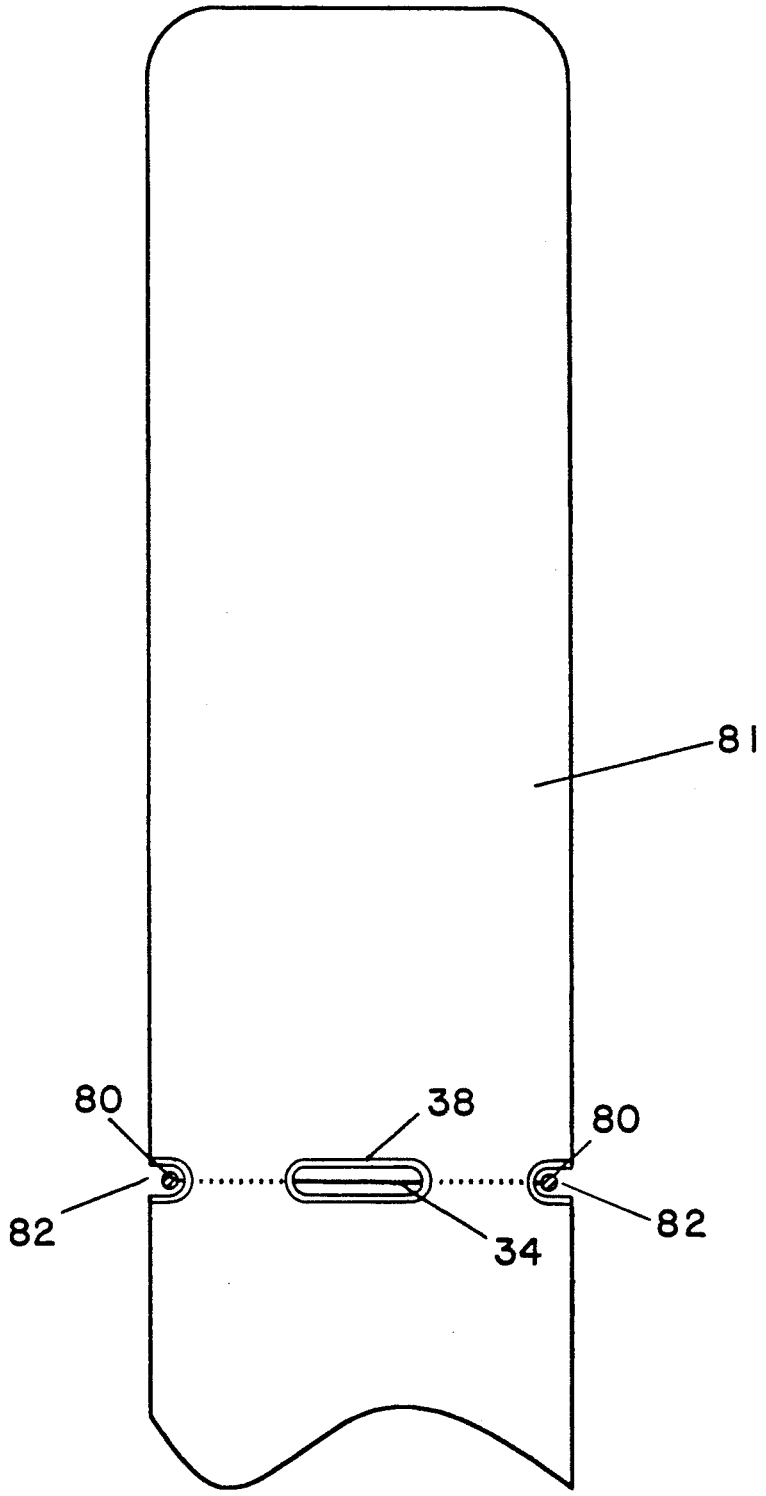
FIG. 10 is a partial elevational view of a slotted slat which may be employed in the present invention.

The rung 34 of the support device 8 is supportingly engaged below the slat 81 when the support members 20 and the rung 34 align with the slots 82 and the central opening 38 of the slat 81 as shown in FIG. 10.

The members 20 are spaced apart between the slots 82 which enable them to frictionally engage the edges of the slots 82 of slats 81. When one of the members 20 is raised, it engages the edges of the slots 82 and pivots one edge upwardly and the other edge downwardly to thereby move the slats to the fully closed position as shown in FIG. 9B.

In this position, the slats 81 comes in contact with each other to form the dead air cells 32 except at those points that correspond with the slots 82. The slot 82 creates a clearance tunnel for the rung 34 to allow the rung 34 to pass below the slat 81 without impeding the creation of the dead air cells 32.

The window covering 2 also includes at least one cord 14 which passes through the central opening 36 in the slat 81 and is attached to the bottomrail 80 that will cause the bottomrail 80 to elevate and collect the slats 81 in a stack above it when the cord 14 is pulled. The cord 14 has an exit point 83 centered atop the bottomrail 80 which thereby causes bottomrail 80 to rotate in unison with the slat 81 when a support member 20 is raised or lowered.

Obvious variations of the above-described embodiments would be apparent to those skilled in the art. Such variations are within the scope of the invention.

We claim:

1. A window covering comprising:

(a) a head rail;

(b) a plurality of slats depending from said head rail having alignable openings therein spaced inwardly from the edges of said slats, wherein each of said slats has a pivot point, wherein said slats are moveable about their pivot points from a closed position which prevents viewing through the window covering through an opened position which allows viewing therethrough, and wherein said slats are configured and positioned relative to one another so as to form contiguous aligned dead air cells therebetween an axial alignment when said slats are in the closed position;

(c) pivoting means operatively connected to said slats for pivoting said slats about their pivot points from the closed contiguous dead air cell position through the opened see-through position, and wherein said pivoting means includes spaced apart members wherein at least one member of which extends through said aligned openings in said slats and is positioned inwardly from said edges of said slats to hide said member when said slats are in the closed position, and a plurality of rungs which are connected to said spaced apart members for supporting said slats; and (d) means independent of said pivoting means for gathering and spacing said slats along said aligned axis.

2. A window covering comprising:

(a) a head rail;

(b) a plurality of slats depending from said head rail having alignable openings therein spaced inwardly from the edges of said slats, wherein each of said slats has a pivot point, wherein said slats are moveable about their pivot points from a closed position which prevents viewing through the window covering through an opened position which allows viewing therethrough, wherein said slats are configured and positioned relative to one another so as to form contiguous dead air cells therebetween in axial alignment when said slats are in the closed position;

(c) means operatively connected to said slats for pivoting said slats about their pivoting points from the closed contiguous dead air cell position through the opened see-through position, and wherein said pivoting means includes spaced apart members wherein at least one member of which extends through aligned openings in said slats and is positioned inwardly from said edges of said slats to hide said member when said slats are in the closed position, and a plurality of transverse members which are connected to said spaced apart members for supporting said slats;

(d) means independent of said pivoting means for gathering and spacing said slats along said aligned axis.

3. A window covering comprising:

(a) a head rail;

(b) a plurality of slats depending from said head rail having at least one column of alignable openings therein spaced inwardly from the edges of said slats, wherein each of said slats has a pivot point, wherein said slats are moveable about their pivot points from a closed position which prevents viewing through the window covering through an opened position which allows viewing therethrough, and wherein said slats are positioned and configured relative to one another so as to form contiguous dead air cells therebetween in axial alignment when said slats are in the closed position;

(c) pivoting means operatively connected to said slats for pivoting said slats about their pivoting points from the closed contiguous dead air cell position through the opened see-through position, and wherein said pivoting means includes spaced apart members, each spaced apart member corresponding to a respective column of aligned openings, wherein at least one of said spaced apart members extends through a respective column of said aligned openings in said slats and is positioned inwardly from said edges of said slats to hide said member when said slats are in the closed position, and wherein said one member has a plurality of nodes which provide support ledges for said slats; and (d) gathering and spacing means independent of said pivoting means for gathering and spacing said slats along said aligned axis.

4. The window covering of claims 1, 2 or 3, wherein said slats include leading and trailing edges, and wherein at least one of said edges of contiguous slats contact at least one other slat to form a dead air cell when said slats are in their closed position.

5. The window covering of claim 4, wherein said slats have a symmetric profile.

6. The window covering of claim 4, wherein said slats have a generally S-shaped cross section.

7. The window covering of claim 4, wherein said slats have an asymmetric profile.

8. The window covering of claim 4, wherein said pivoting means supports said slats at a pivot point such that a plane passing through the pivot point of the slat lies between respective parallel planes passing through said leading and trailing edges of the slat.

9. The window covering of claim 8, wherein said pivot point is the centerpoint of said slat.

10. The window covering to claims 1, 2 or 3, wherein said contiguous dead air cells have at least two layers of slats along the length of each of said contiguous dead air cells when said slats are in the closed position.

11. The window covering of claims 1, 2 and 3, wherein said slats are positioned and configured relative to one another with their pivot points spaced apart at a distance less than half the width of a slat so as to form contiguous dead air cells therebetween in axial alignment when said slats are in the closed position.

12. The window covering of claim 4, wherein said independent gathering and spacing means includes a cord which extends through said slats for gathering and spacing said slats, wherein said cord is positioned inwardly from said edges of said slats, and wherein said cord is hidden from view when said slats are in the closed position.

13. A window covering comprising:

(a) a head rail for attachment to a window frame;

(b) a plurality of slats between said rails pivotally moveable between a closed position to prevent viewing through the window covering and an opened position to allow viewing therethrough, wherein each of said slats is configured to include a portion on one side of the pivot point of said slat which is above the pivot point of said slat and a portion on the other side of the pivot point of said slat which is below the pivot point when said slat is in its opened position, wherein said configured slats are positioned relative to one another so as to form a row of contiguous dead air cells along the longitudinal axis of said slats and between said rails having at least two layers of slats along the length of each of said cells when said slats are in the closed position;

(c) means operatively connected to said slats for pivoting said slats from their closed contiguous dead air cell position through their opened see-through position;

(d) a bottom rail below said slats that remains stationary when said slats are pivoted by said pivoting means; and (e) means independent of said pivoting means operatively connected to said bottom rail for gathering and spacing said slats to and from said top rail independent of the position of said slats.

14. A venetian blind comprising:

(a) a head rail for attachment to a window frame;

(b) a plurality of generally S-shaped slats therebetween wherein said slats include leading and trailing edges and are moveable about pivot points to a closed position with the edges of contiguous slats in contact with one another for preventing viewing through said blind and to an opened position for viewing therethrough, and wherein said generally S-shaped slats are positioned relative to one another with their pivot points spaced apart at a distance less than half the width of a slat so as to form a row of longitudinal contiguous dead air cells between said rails when the edges of contiguous slats are in contact with one another in the closed position of the blind;

(c) pivoting means extending from said head rail and operatively connected to said slats for pivoting said slats from their closed contiguous cell forming position through their open see-through position;

(d) a bottom rail below said slats that remains stationary when said slats are pivoted by said pivoting means; and (e) means independent of said pivoting means extending from said head rail and operatively connected to said bottom rail for raising and lowering said slats and bottom rail to and from said head rail regardless of the position of said slats.

15. The window covering of claims 13 or 14, wherein at least one of the head rail and bottom rail comprises a baffle extending therefrom and adapted to obstruct light, sound and air when said slats are in the closed position.

16. The window covering of claims 13 or 14, a rotation assembly including a shaft operatively connected to a tilt drum, wherein said spaced apart members are attached at one end to the tilt drum, and means for rotating the tilt drum, wherein when the tilt drum is rotated one of the spaced apart members rises while the other falls causing said slats to pivot.

17. The window covering of claim 16, wherein the spaced apart members have opposed ends attached respectively to the head rail and bottom rail.

* * * * *